US007056186B1

(12) United States Patent
Weyenberg et al.

(10) Patent No.: US 7,056,186 B1
(45) Date of Patent: Jun. 6, 2006

(54) CLEAVAGE-ENHANCING FOUNDATION GARMENT

(76) Inventors: Karey M. Weyenberg, 737 St. Sylvester Dr., South Milwaukee, WI (US) 53172; Brian M. Weyenberg, 737 St. Sylvester Dr., South Milwaukee, WI (US) 53172

( * ) Notice: Subject to any disclaimer, the term of this patent is extended or adjusted under 35 U.S.C. 154(b) by 0 days.

(21) Appl. No.: 11/099,844

(22) Filed: Apr. 6, 2005

(51) Int. Cl.
*A41C 3/00* (2006.01)

(52) U.S. Cl. ..... 450/58; 450/62; 450/65

(58) Field of Classification Search ..... 450/8–10, 450/58, 59, 62, 63, 64, 79, 85, 86, 88, 75
See application file for complete search history.

(56) References Cited

U.S. PATENT DOCUMENTS

| | | | | | |
|---|---|---|---|---|---|
| 1,966,174 | A | * | 7/1934 | Jones | 450/58 |
| 2,152,629 | A | * | 4/1939 | Gluckin | 450/59 |
| 2,449,808 | A | * | 9/1948 | Glick | 450/79 |
| 2,484,440 | A | * | 10/1949 | Witkower | 450/59 |
| 2,607,038 | A | * | 8/1952 | Spare | 450/59 |
| 2,970,597 | A | * | 2/1961 | Milton | 450/58 |
| 3,459,190 | A | * | 8/1969 | Frischer et al. | 450/59 |
| 4,269,191 | A | * | 5/1981 | Evans | 450/64 |
| 4,300,568 | A | * | 11/1981 | Blanckmeister | 450/85 |
| 5,180,326 | A | * | 1/1993 | Williams | 450/91 |
| 5,378,192 | A | * | 1/1995 | Darmante | 450/58 |
| 5,749,768 | A | | 5/1998 | Green | |
| 5,863,236 | A | | 1/1999 | Johnson | |
| 5,971,834 | A | | 10/1999 | Murray | |
| 6,023,785 | A | | 2/2000 | Johnson | |
| D475,506 | S | | 6/2003 | Hoffman et al. | |
| 6,755,717 | B1 | | 6/2004 | Smith | |
| 2004/0110447 | A1 | | 6/2004 | Mitchell et al. | |

OTHER PUBLICATIONS

Web site: www.gaiam.com; Adjustable Sports Bra, Dec. 30, 2004.
Web site: www.christinastudio.com; Power Wrap Bra, Dec. 30, 2004.

* cited by examiner

*Primary Examiner*—Gloria M. Hale
(74) *Attorney, Agent, or Firm*—Ryan Kromholz & Manion, S.C.

(57) ABSTRACT

A foundation garment enhances cleavage by positioning and supporting the breasts in a more inward position. The foundation garment permits a woman to selectively adjust and control the amount of inward movement of the breasts as desired.

17 Claims, 9 Drawing Sheets

CLEAVAGE-ENHANCING FOUNDATION GARMENT

FIELD OF THE INVENTION

This invention relates to foundation garments. In particular, the invention relates to adjustable brassieres.

BACKGROUND OF THE INVENTION

Women commonly wear a brassiere to support the breasts and to control excessive and/or undesired movement of the breasts. In addition to controlling movement of the breasts, many brassieres also provide an underwire or other means of lifting the breasts upward to provide a more cosmetically-appealing figure. The amount of upward lift is typically only minimally adjustable through the use of adjustable shoulder straps.

Conventional brassieres do not provide the ability to move or hold the breasts in a more inward position. The positioning and holding of the breasts in a more inward position is desirable because it enhances cleavage. This is particularly desirable if the woman is wearing a low cut top or garment over the brassiere.

The need remains for a brassiere that enhances cleavage by positioning and supporting the breasts in a more inward position. In particular, the need remains for a brassiere that permits a woman to selectively adjust and control the amount of inward movement of the breasts as desired, e.g., depending on whether she is wearing a low cut or higher cut garment over the brassiere.

SUMMARY OF THE INVENTION

A foundation garment enhances cleavage by positioning and supporting the breasts in a more inward position. The foundation garment permits a woman to selectively adjust and control the amount of inward movement of the breasts as desired.

According to one aspect of the invention, a foundation garment comprises left and right breast support regions comprising a material having a first elasticity. A left band extends in use along at least a portion of the left breast support region. The left band has a first end positionable at or near the lateral margin of the left breast and a second end positionable at or near the medial margin of the left breast and enables placement of the left band, at least in part, on at least a portion of the underside of the left breast. A right band extends in use along at least a portion of the right breast support region. The right band has a first end positionable at or near the lateral margin of the right breast and a second end positionable at or near the medial margin of the right breast and enables placement of the right band, at least in part, on at least a portion of the underside of the right breast. The left and right bands are of a second elasticity greater than the first elasticity. Means are provided for applying a pulling force to the second end of the left band to position the left breast in a more inward position. Means are also provided for applying a pulling force to the second end of the right band to position the right breast in a more inward position.

In one embodiment, the left and right support regions comprise cups and the left and right bands extend along essentially the entire length of the left and right cups respectively.

In one embodiment, the foundation garment is front-closing. In another embodiment, the foundation garment is back-closing.

DESCRIPTION OF THE PREFERRED EMBODIMENT

FIGS. 1–8 illustrate a foundation garment, i.e., a brassiere 10, which permits selective adjustment to position the breasts in a more inward position. While the features will be described in accordance with a brassiere 10, it is to be understood that features of the invention are also suitable for use in a variety of other breast support and foundation garments, including but not limited to bathing suit tops, halter tops, pajama or nightgown tops, and other types of lingerie.

It is also to be understood that while the features are illustrated in accordance with a conventional style of brassiere 10, the specific style of brassiere 10 may be varied, e.g., strapless, halter-style, athletic brassiere, etc.

Figure 1:
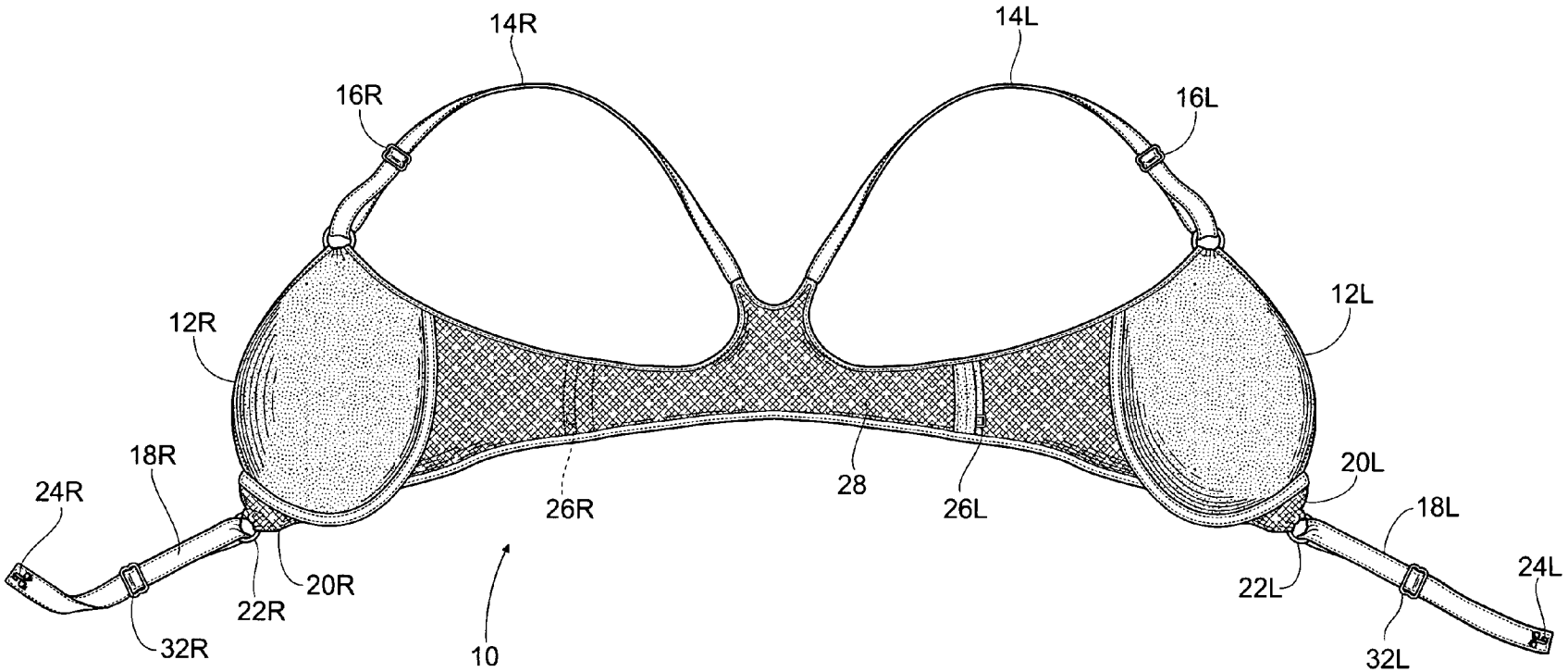
FIG. 1 is a perspective view of a brassiere permitting adjustable inward movement of the breasts in an open or unlatched configuration.

As best shown in FIG. 1, the brassiere 10 is a front-closing brassiere having a pair of conventional right and left cups, 12R and 12L respectively, available in standard cup sizes (e.g., A, B, C, etc.). Shoulder straps 14R and 14L are adjustable respectively by conventional adjustment members, e.g., sliding rings 16R and 16L. A first adjustable strap 18R is attached to the first or right cup 12R by a first tab 20R. A second adjustable strap 18L is similarly attached to the second or left cup 12L by a second tab 20L. Straps 18R and 18L may be attached to tabs 20R and 20L by any suitable attachment means. In the illustrated embodiment, the straps 18R and 18L are attached by use of rings 22R and 22L respectively. In a preferred embodiment, straps 18R and 18L are formed of an elastic material and are desirably of a greater elasticity than the material forming cups 12R and 12L.

Figure 2:
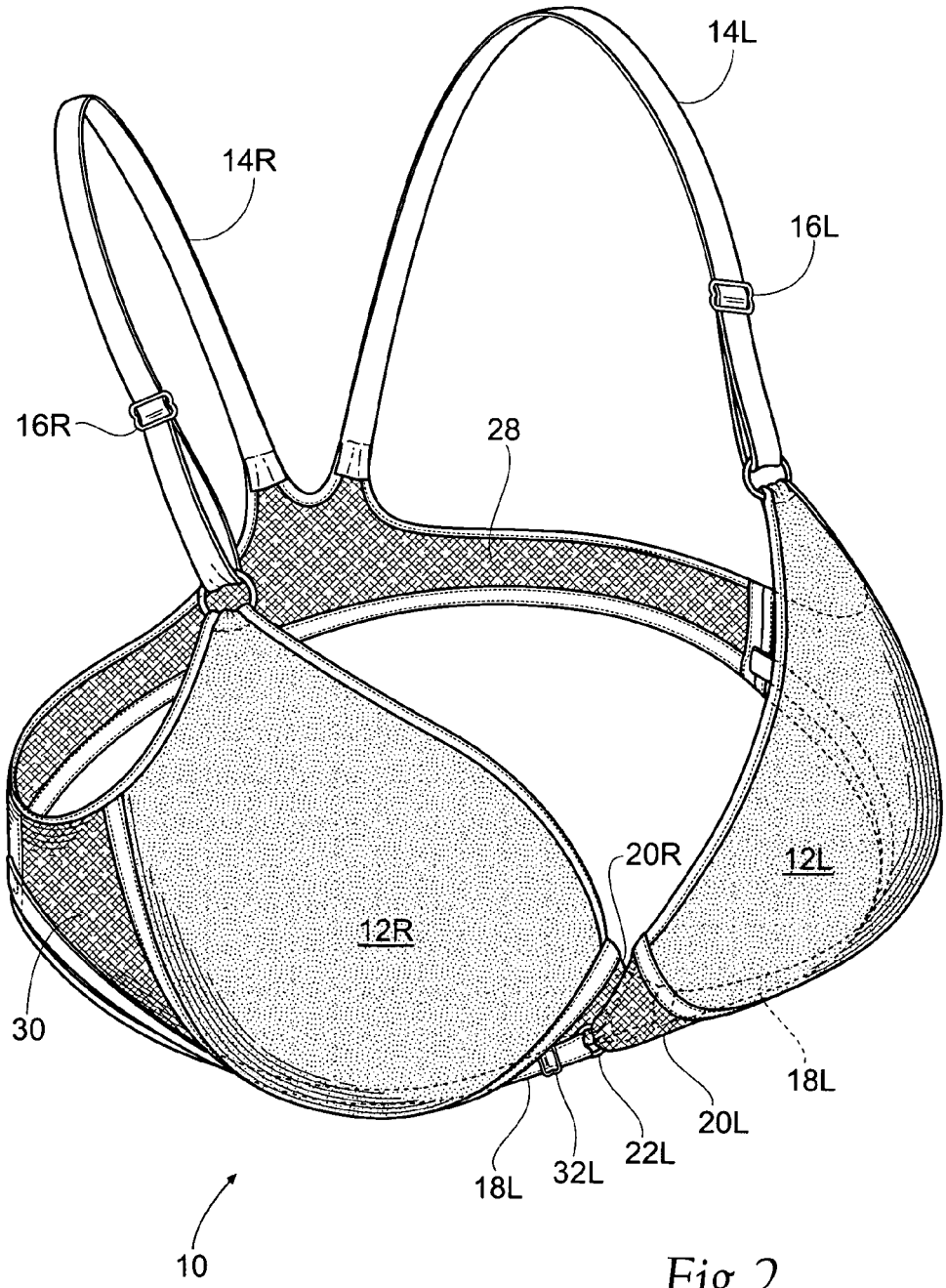
FIG. 2 is a perspective view of the brassiere shown in FIG. 1 in a closed or latched configuration.

Strap 18R includes a fixation member, e.g., hook 24R, which couples with a complementary fixation member, e.g., eyelet 26L, on the inner surface 28 of the opposing side of the brassiere 10 in an area beyond left cup 12L. Coupling of fixation members 24R and 26L positions and extends the strap 18R, in use, along the left cup 12L, as best shown in FIG. 2. Similarly, strap 18L includes a fixation member, e.g., hook 24L, which couples with a complementary fixation member, e.g., eyelet 26R, on the outer surface 30 of the opposing side of the brassiere 10 in an area beyond right cup 12R (see FIG. 5). Coupling of fixation members 24L and 26R positions and extends the strap 18L, in use, along the right cup 12R, as also best shown in FIG. 2.

It will be apparent to one of skill in the art that the position of eyelets 26R and 26L relative to cups 12R and 12L may vary as desired. For example, eyelets 26R and 26L may be positioned on or along the respective cup 12R and 12L or at any point beyond the respective cup 12R and 12L. In addition, the height of the eyelets 26R and 26L along the brassiere 10 may be varied as desired. Raising the vertical height of placement of the eyelets 26R and 26L will serve to provide additional uplift to the breasts RB and LB.

It will also be apparent to one of skill in the art that a variety of other types fixation members may be used, including, by way of example and not limitation, snaps, buttons, Velcro™, etc. Straps 18R and 18L desirably include conventional adjustment members, e.g., sliding rings 32R and 32L. Each strap 18R and 18L is attached to its respective ring 32R or 32L at one end (end opposite fixation member 24R or 24L) to permit sliding of the ring 32R or 32L as is well-known in the art to permit selective adjustment (i.e., tightening and loosening) of the straps 18R and 18L.

Figure 3:
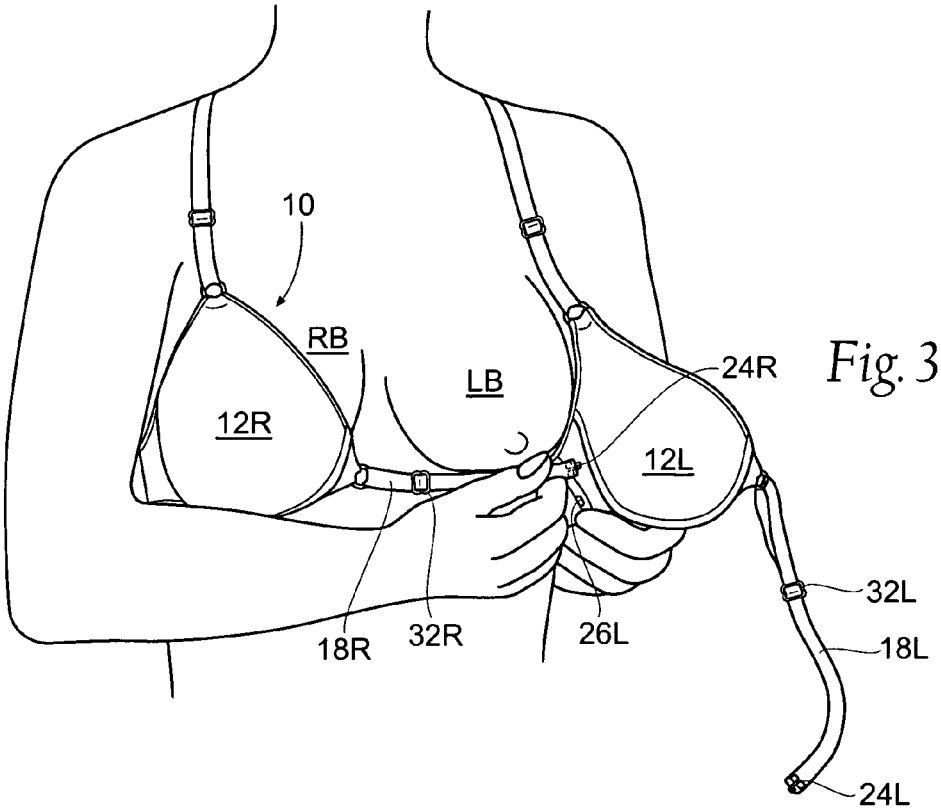
FIG. 3 illustrates the coupling of a first strap to an interior surface of the brassiere.
Figure 4:
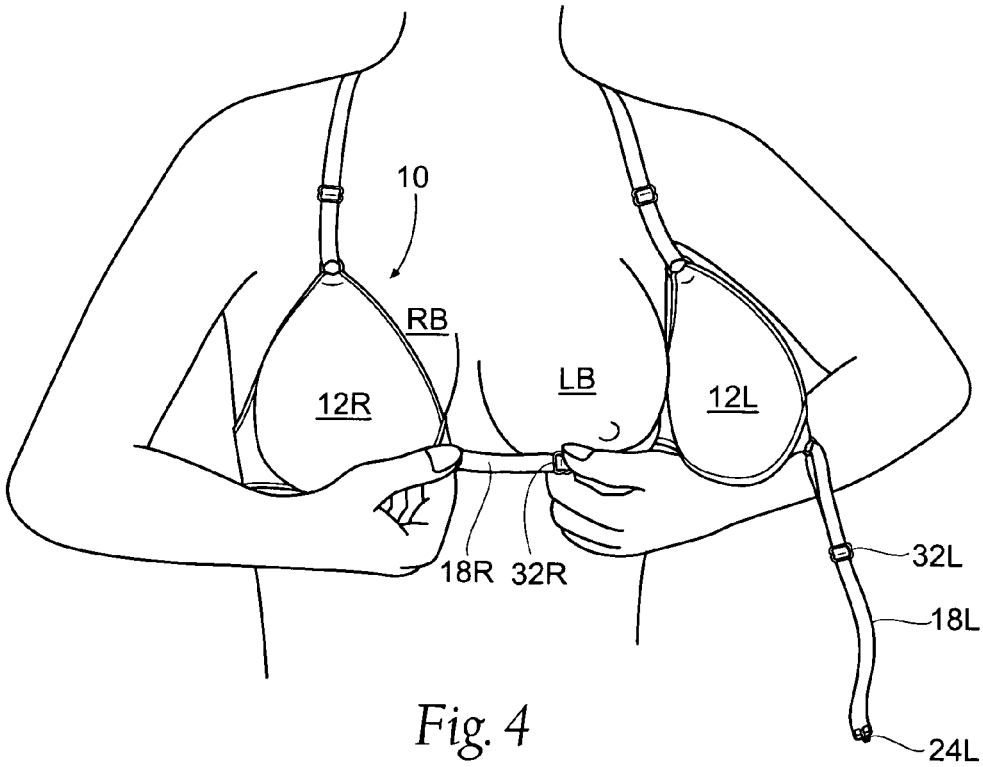
FIG. 4 illustrates the adjustment of the first strap to position the first breast in a more inward position.

In use, the wearer first secures the right strap 18R in place by coupling fixation elements 24R and 26L, as shown in FIG. 3. Strap 18R extends from at or near the lateral margin 34L of the left breast LB to at or near the medial margin 36L of the left breast LB along the underside 38L of the left breast LB (see FIGS. 7 and 8). As FIG. 4 illustrates, the wearer then adjusts the adjustment member 32R as desired. As strap 18R is shortened, pressure is increased on cup 12R to move the right breast (RB) inward.

Figure 5:
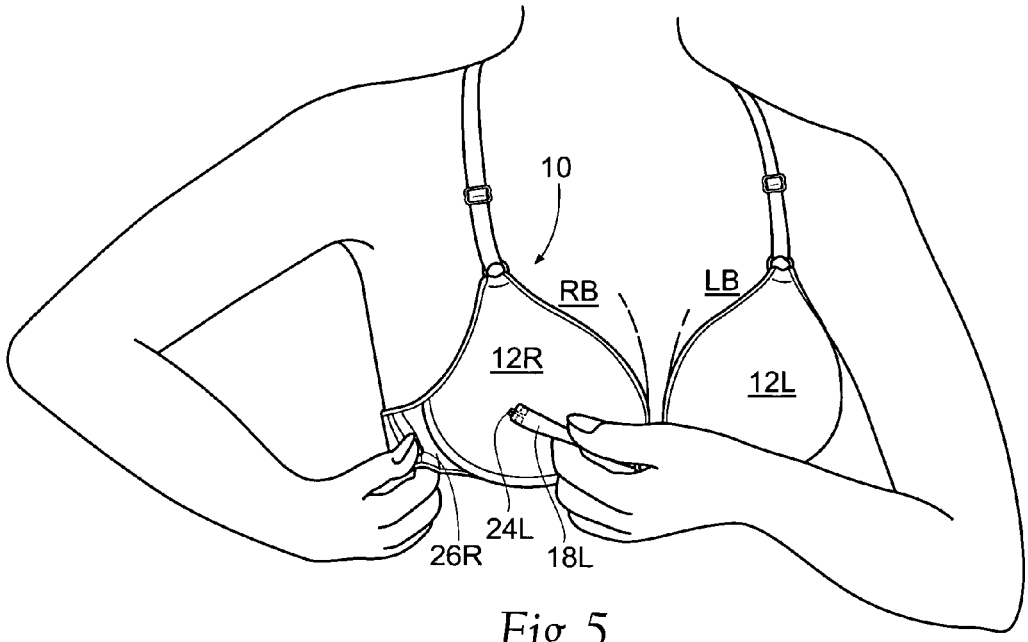
FIG. 5 illustrates the coupling of a second strap to an exterior surface of the brassiere.
Figure 6:
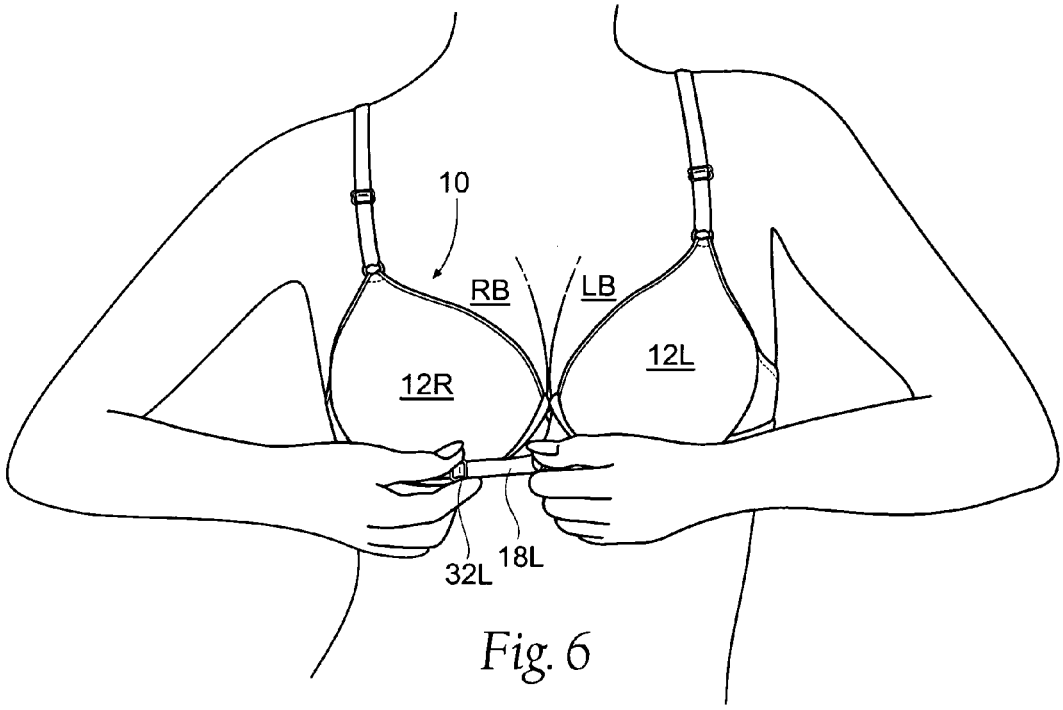
FIG. 6 illustrates the adjustment of the second strap to position the second breast in a more inward position.

The wearer then secures the left strap 18L in place by coupling fixation elements 24L and 26R, as seen in FIG. 5. Strap 18L extends from at or near the lateral margin 34R of the right breast RB to at or near the medial margin 36R of the right breast RB along the underside 38R of the right breast RB (see FIGS. 7 and 8). The wearer then adjusts the adjustment member 32L as desired, as FIG. 6 illustrates. As strap 18L is shortened, pressure is increased on cup 12L to move the left breast (LB) inward.

The wearer is thereby able to selectively adjust both straps 18R and 18L as desired. In this manner, the adjustability of the straps 18R and 18L permits the wearer to selectively adjust between a first position, shown in FIG. 7, and a second position, shown in FIG. 8, in which the breasts RB and LB are supported in a more inward position relative to FIG. 7, thereby enhancing cleavage (C). Independent adjustment of straps 18R and 18L also permits the wearer to adjust for comfort and according to ribcage size.

Figure 7:
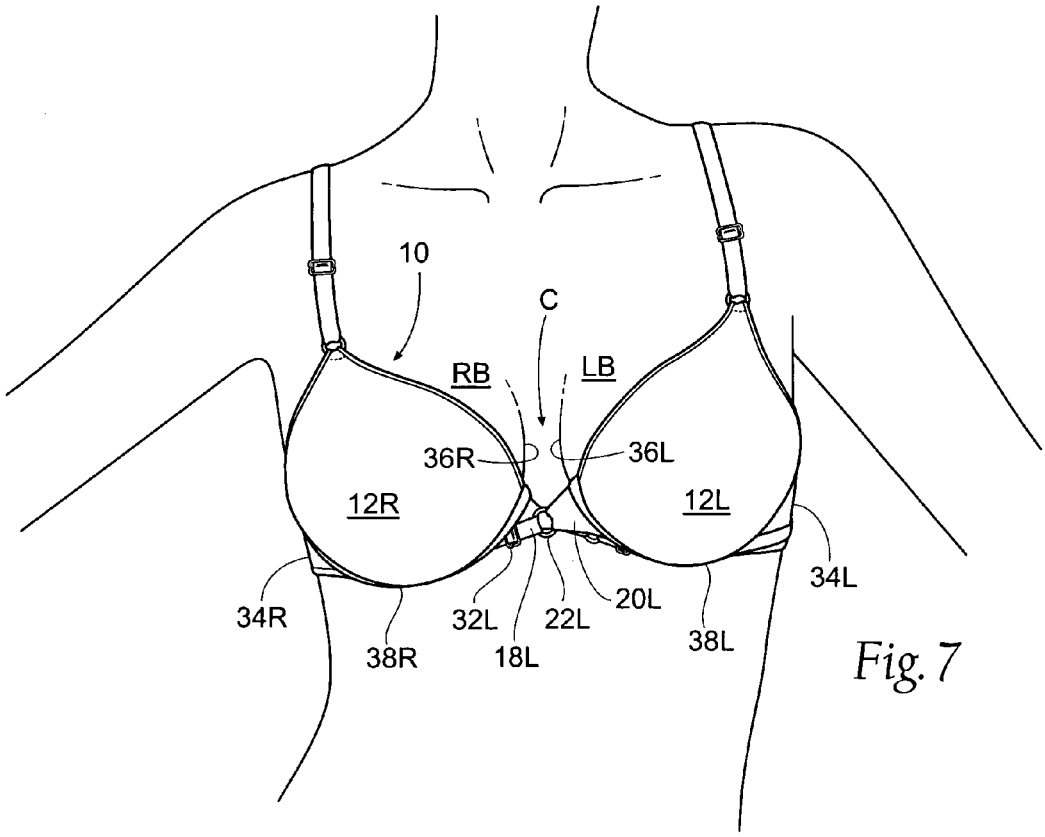
FIG. 7 illustrates the placement of the breasts with the first and second straps in a first position.
Figure 8:
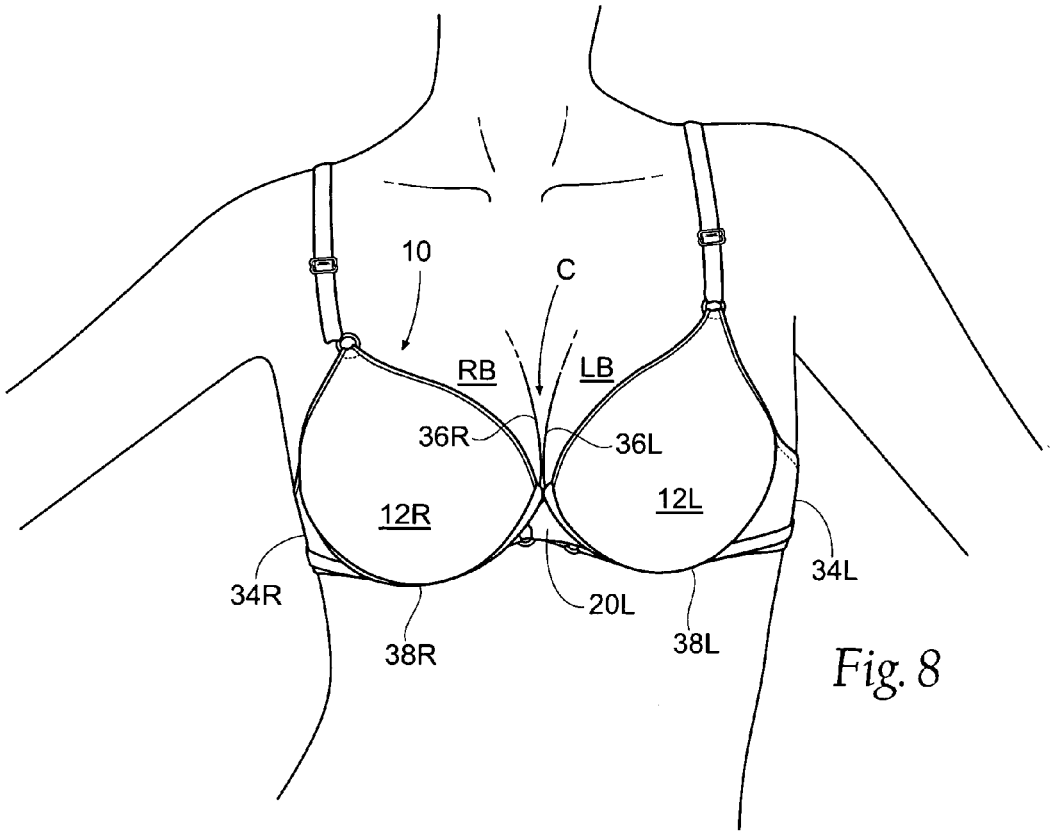
FIG. 8 illustrates the adjustment of the first and second straps to a second position in which the breasts have been positioned further inward relative to the first position to enhance cleavage.

The brassiere 10 allows the wearer the versatility of adjusting the brassiere 10 according to specific needs or specific clothing. For example, the brassiere 10 can be worn as shown in FIG. 7 with a high cut top. The wearer can then adjust the brassiere 10 as shown in FIG. 8 when changing to a lower cut top without the need to change into another brassiere, e.g, when changing from daytime or casual wear to evening or dress wear.

Figure 9:
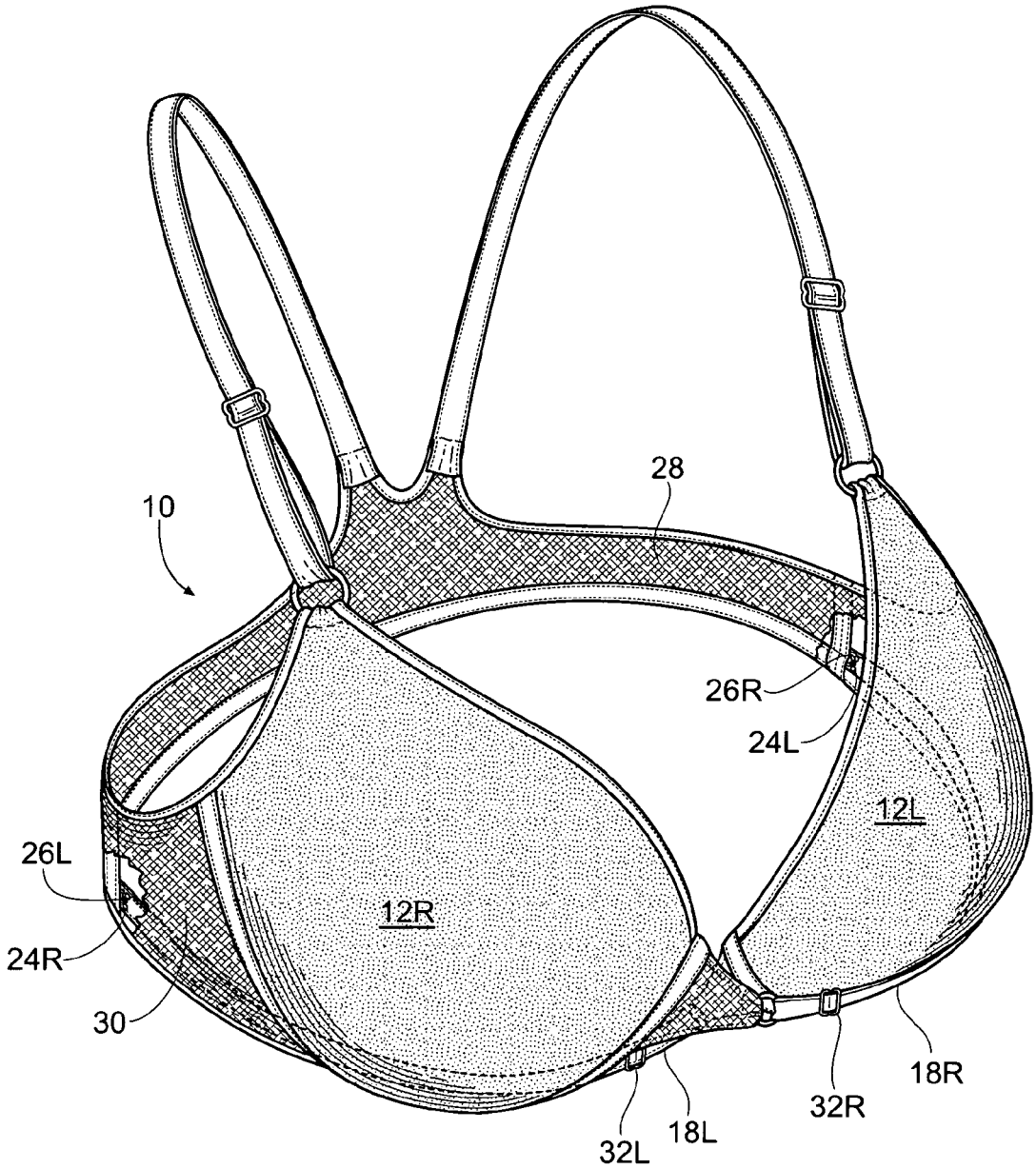
FIG. 9 is a perspective view of an alternative embodiment of the embodiment of FIG. 1.
Figure 10:
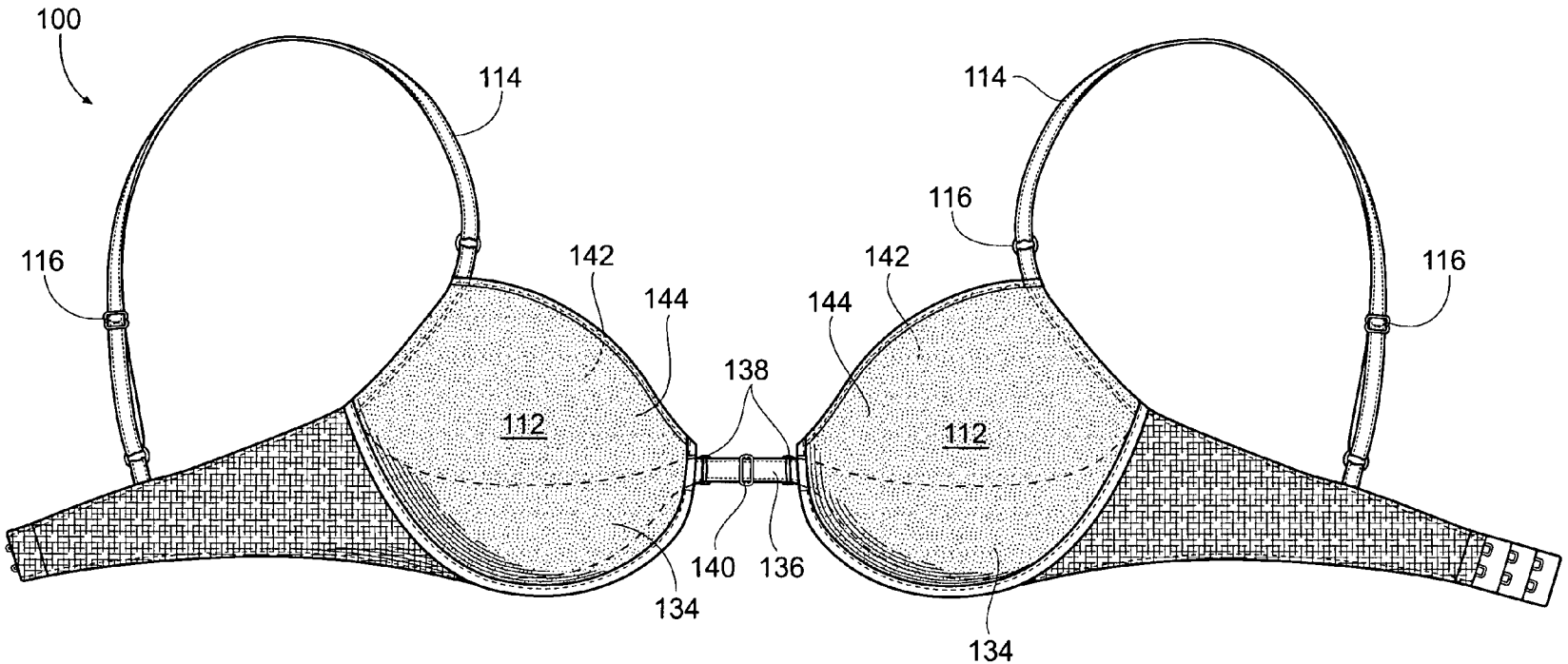
FIG. 10 is a perspective view of another alternative embodiment of a brassiere permitting adjustable inward movement of the breasts in an open or unlatched configuration.
Figure 11:
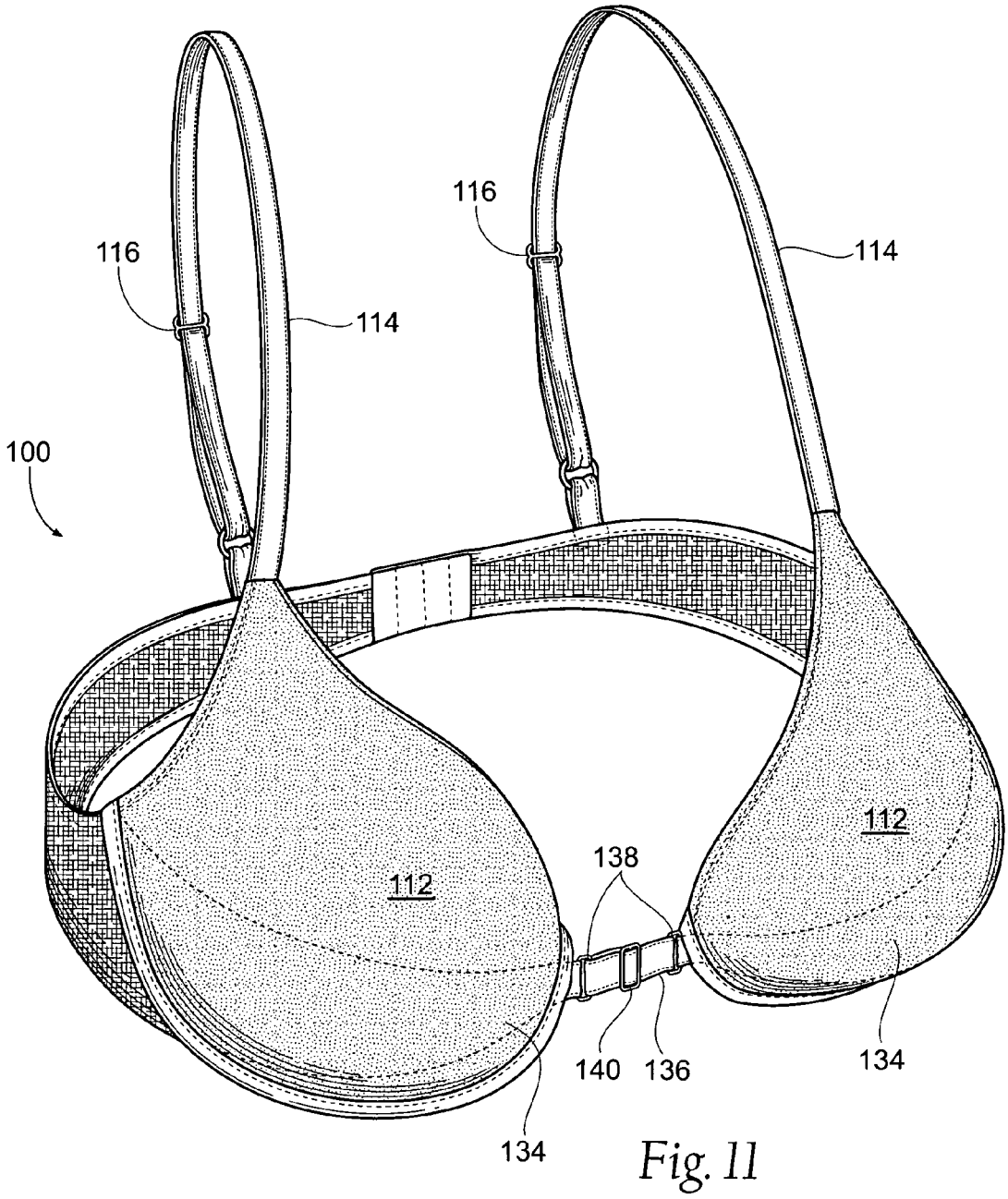
FIG. 11 is a perspective view of the brassiere shown in FIG. 10 in a closed or latched configuration.
Figure 12:
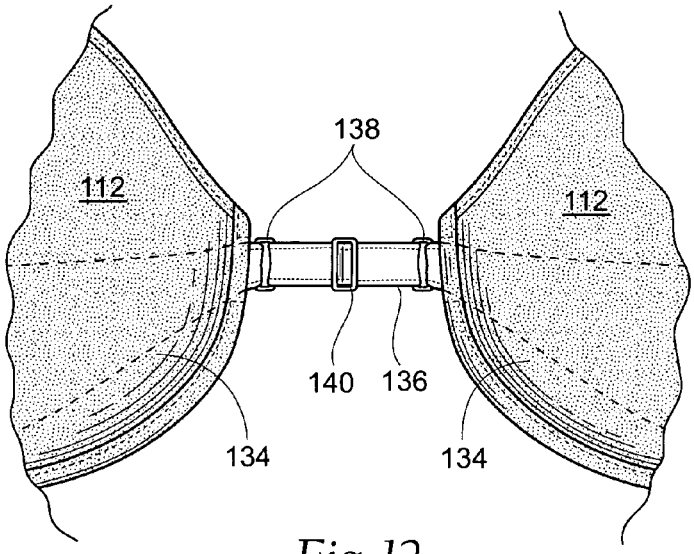
FIG. 12 is an enlarged fragmentary view of the adjustable cup strap shown in FIGS. 10 and 11.

FIG. 9 illustrates an alternative embodiment of the brassiere 10 shown in FIGS. 1–8. In this embodiment, eyelet 26R is located on the inner surface 28 of the brassiere 10 in an area beyond right cup 12R (rather than on the outer surface 30). Eyelet 26L is located on the outer surface 30 of the brassiere 10 in an area beyond left cup 12L (rather than on the inner surface 28). In use, the wearer first secures the left strap 18L in place by coupling fixation elements 24L and 26R. The adjustment member 32L is then adjusted as previously described to position the left breast (LB) as desired. The wearer then secures the right strap 18R in place by coupling fixation elements 24R and 26L. The adjustment member 32R is then adjusted as also previously described to position the right breast (RB) as desired.

FIGS. 10–13 illustrate another alternative embodiment of a foundation garment or brassiere 100 that permits selective adjustment to position the breasts in a more inward position. It is to be understood that features of the invention are also suitable for use in a variety of other breast support and foundation garments.

It is also to be understood that while the features are illustrated in accordance with a conventional style of brassiere 100, the specific style of brassiere 100 may be varied, e.g., strapless, halter-style, athletic brassiere, etc.

The brassiere 100 is a back-closing brassiere having a pair of conventional cups 112, available in standard cup sizes (e.g., A, B, C, etc.). Shoulder straps 114 are adjustable by conventional adjustment members, e.g., sliding rings 116.

An elastic member or band 134 extends along each cup 112. The elastic band 134 is of greater elasticity than the material forming cups 112. In the illustrated embodiment, the band 134 is positioned along the cup 112 on the inside surface 142 of the cup 112. Alternatively, the band 134 may be positioned along the cup 112 on the outer surface 144 of the cup 112 (not shown). In yet another embodiment, the band 134 may be positioned between layers of fabric forming the cup 112 (not shown). Each band 134 desirably extends along at least a portion of its respective cup 112, and more preferably along the entire length of cup 112.

The elastic bands 134 are attached to opposing ends of an adjustable member or strap 136, e.g., by rings 138 or other suitable coupling means. A first end of strap 136 is attached to ring 140 and the opposing end of strap 136 is attached to coupling element 136 to permit sliding of the ring 140 as is well-known in the art to allow selective adjustment (i.e., tightening and loosening) of the strap 136.

Figure 13:
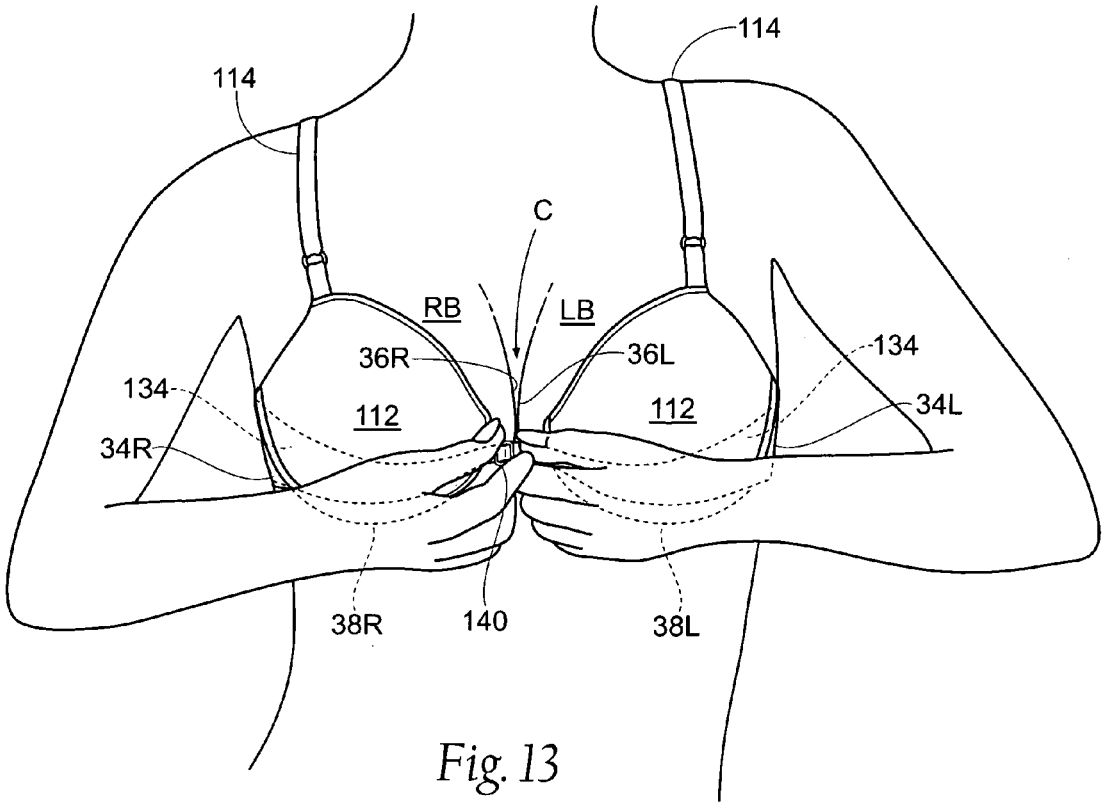
FIG. 13 illustrates the adjustment of the strap shown in FIG. 12 to position the breasts in a more inward position.

In use, each band 134 is positioned to extend from at or near the lateral margin 34L or 34R of its respective breast LB or RB to at or near the medial margin 36L or 34R of the breast LB or RB along the underside 38L or 38R of the breast LB or RB (see FIG. 13)

Tightening the strap 136 by pulling the ring 140 in a first direction places pressure on elastic bands 134 to place the breasts in a more inward position, thereby enhancing cleavage C. Conversely, loosening the strap 136 by pulling the ring 140 in a second or opposite direction releases pressure on the elastic bands 134, thereby causing the breasts to move to a more relaxed and less inward position.

What is claimed is:

1. A foundation garment comprising left and right breast support regions comprising a material having a first elasticity, a first band coupled to the right breast support region and extending in use along at least a portion of the left breast support region, the first band having a first end positionable at or near a lateral margin of a left breast and a second end positionable at or near a medial margin of the right breast and enabling placement of the first band, at least in part, on at least a portion of an underside of the left breast, a second band coupled to the left breast support region and extending in use along at least a portion of the right breast support region, the second band having a first end positionable at or near a lateral margin of a right breast and a second end positionable at or near a medial margin of the left breast and enabling placement of the second band, at least in part, on at least a portion of an underside of the right breast, the first and second bands being of a second elasticity greater than the first elasticity, means for applying a pulling force to the first band to apply an inward force across the right breast to position the right breast in a more medial position, and means for applying a pulling force to the second band to apply an inward force across the left breast to position the left breast in a more medial position.

2. A foundation garment as in claim 1 wherein the left and right support regions comprise cups, and wherein the first and second bands extend along essentially the entire length of the left and right cups respectively.

3. A foundation garment as in claim 1 wherein the foundation garment is front-closing.

4. A foundation garment as in claim 1 wherein the first end of the first band is a free end; and the pulling force is applied to the first end of the first band.

5. A foundation garment as in claim 1 wherein the first end of the second band if a free end; and the pulling force is applied to the first end of the second band.

6. A breast support garment comprising a first support region for supporting a first breast;

a second support region for supporting a second breast;

said first support region and said second support region having a first elasticity;

a first member extending laterally from the first support region and adapted to extend, at least in part, under the second breast for coupling the garment; and a second member extending laterally from the second support region and adapted to extend, at least in part, under the first breast for coupling the garment;

said first member and said second member having a second elasticity, said second elasticity being greater than said first elasticity.

7. A breast support garment as in claim 6 wherein the first member is adapted for coupling to an inside surface of the garment.

8. A breast support garment as in claim 6 wherein the second member is adapted for coupling to an outside surface of the garment.

9. A breast support garment as in claim 6 wherein the first member extends from a medial end of the first support region.

10. A breast support garment as in claim 6 wherein the second member extends from a medial end of the second support region.

11. A breast support garment as in claim 6 wherein the first member is length-adjustable and decreasing the length of the first member places inward pressure across the first breast to move the first breast to a more medial position.

12. A breast support garment as in claim 6 wherein the second member is length-adjustable and decreasing the length of the second member places inward pressure across the second breast to move the second breast to a more medial position.

13. A breast support garment as in claim 6 wherein the first member is adapted for coupling to the garment at or near a lateral margin of the second breast.

14. A breast support garment as in claim 6 wherein the second member is adapted for coupling to the garment at or near a lateral margin of the first breast.

15. A foundation garment comprising a first support region for supporting a breast;

a second support region for supporting a second breast;

said first support region and said second support region having a first elasticity;

means for applying a pulling force across the first breast to move the first breast to a more medial position, said means having a second elasticity;

means for applying a pulling force across the second breast to move the second breast to a more medial position, said means having a second elasticity;

said second elasticity being greater than said first elasticity;

means for securing the first breast in the more medial position; and means for securing the second breast in the more medial position.

16. A foundation garment as in claim 15 wherein the pulling force is applied across the first breast from a lateral margin of the first breast to a medial margin of the first breast.

17. A foundation garment as in claim 15 wherein the pulling force is applied across the first breast from a lateral margin of the second breast to a medial margin of the second breast.

* * * * *